United States Patent [19]

Bittner et al.

[11] Patent Number: 4,543,002

[45] Date of Patent: Sep. 24, 1985

[54] MULTICOLOR PRINTING

[75] Inventors: John R. Bittner; Ralph S. Billing, both of Waynesboro; Robert T. Stewart, Jr., Verona, all of Va.

[73] Assignee: Genicom Corporation, Waynesboro, Va.

[21] Appl. No.: 504,959

[22] Filed: Jun. 16, 1983

[51] Int. Cl.[4] ..... B41J 35/14; B41J 35/16; B41J 33/34

[52] U.S. Cl. ..... 400/212; 400/216.1; 400/225; 400/240.4

[58] Field of Search ..... 400/240.4, 212, 216.1, 400/216.2, 225

[56] References Cited

U.S. PATENT DOCUMENTS

| | | | |
|---|---|---|---|
| 3,782,278 | 1/1974 | Barnett et al. | 101/93.04 |
| 3,819,028 | 6/1974 | Drillick | 400/225 X |
| 3,941,051 | 3/1976 | Barrus et al. | 101/93.04 |
| 3,991,676 | 11/1976 | Sasaki | 101/336 |
| 4,073,371 | 2/1978 | Prager | 400/212 X |
| 4,084,503 | 4/1978 | Pylant et al. | 101/93.04 X |
| 4,159,882 | 7/1979 | Sanders et al. | 400/124 |
| 4,289,069 | 9/1981 | Melissa et al. | 101/93.01 |
| 4,407,595 | 10/1983 | Gershnow | 400/240.4 X |

FOREIGN PATENT DOCUMENTS

| | | | |
|---|---|---|---|
| 48418 | 3/1982 | European Pat. Off. | 400/216.1 |
| 2432940 | 3/1975 | Fed. Rep. of Germany | 400/212 |
| 57-688 | 4/1982 | Japan | 400/212 |

OTHER PUBLICATIONS

*IBM Tech. Disc. Bulletin,* by G. N. Baker et al., vol. 24, No. 1A, Jun. 1981, p. 401.

*Primary Examiner*—Paul T. Sewell

*Attorney, Agent, or Firm*—Cushman, Darby & Cushman

[57] ABSTRACT

This disclosure describes a simplified mechanism by which a multitude of ribbon styles may be both transported across a record medium of a data communications printer and shifted band to band to obtain color printing results.

5 Claims, 6 Drawing Figures

F'G.4B.

MULTICOLOR PRINTING

BACKGROUND OF THE INVENTION

The present invention is related to multicolor printing involving impact printing with a movable inked ribbon and more particularly to control circuitry for coordinating the motion of the inked ribbon with the relative movement of a print head and a record medium, and with the impact printing action of the print head on such medium.

This application is related to copending commonly assigned U.S. patent application Ser. No. 399,129 filed July 16, 1982 and Ser. No. 399,216 filed July 19, 1982 and Ser. No. 399,130 filed July 16, 1982 and Ser. No. 494,350 filed May 13, 1983. The disclosure of these related applications is hereby incorporated by reference.

The use of multicolor inked ribbons in printers, such as for example dot matrix printers, for various printing applications is known. The trend in this field has been to higher printing speeds, higher density and more varied color combinations. This has been particularly true in applications involving graphic display. This trend has led to problems in achieving ribbon movement in a plurality of directions and coordinating this movement with the motion of the print head carriage and the printing action of individually controllable dot print wires in the print head. Additionally, with bidirectional printing in which printed dot elements are interlaced or overprinted to achieve color mixing, it is necessary to control ribbon movement vertically as well as horizontally. Prior art arrangements have suffered in their inability to perform these functions very quickly and precisely with a high degree of reliability and control.

Accordingly, one object of this invention applicable to impact printing involving an inked ribbon comprising bands of different colors of the same or differing width running the length of the ribbon, is to provide an improved arrangement for printing symbols in a wide variety of color combinations while taking into account the extent to which different colors may differ in their frequency of use.

Accordingly, a further object of this invention is to provide an improved control for multicolor printing of symbols.

A further object of this invention is to provide an improved arrangement for controlling ribbon movement vertically as well as horizontally.

A further object of this invention is to provide an improved arrangement for achieving multicolored ribbon movement in desired directions while coordinating this movement with the motion of the print head and the individually controllable dot print wires in the print head of a matrix printer.

A further object of this invention is an improved arrangement to control incremental stepping of a ribbon vertically in either direction to present a multiplicity of bands of a ribbon to the print line.

A further object of this invention is to provide an improved arrangement for selectively changing the pattern of bands to be presented to the print line.

Briefly, in accordance with one embodiment of the invention there is provided an arrangement for printing symbols along a line of print in a combination of desired colors corresponding to parallel bands of different colored ribbon movable along the line of print involving a movable print head comprising a plurality of print wires which may be selectively actuated to impact a desired color band of the ribbon against a record medium. Means are provided for moving said ribbon in response to a first set of control pulses along a print line at a desired rate. Means responsive to a second set of control pulses are provided to increment the ribbon vertically in either direction to present a desired color of said ribbon to said print line at a desired column location along said print line. Means responsive to a third set of control pulses are provided to move the print head along said print line to said desired column position. Means responsive to a fourth set of control pulses are provided to activate selective print wires in a direction to impact said color band of said ribbon against said record medium to effect printing of dots corresponding to said activated print wires in said desired color on said record medium. The means for incrementing the ribbon vertically and for positioning it in front of the print head at the desired color band of ribbon comprises a ribbon shift shutter receiving the ribbon moving across the line of print coupled for movement with the print head. A pair of lift levers carrying ribbon guide rollers at each end are positioned at opposite ends of said print line and adapted for rotational motion at one end remote from said print line about an axis. Means for moving said shift shutter vertically in response to control pulses comprise a stepping motor and associated lead screw and nut arrangement located at opposite ends of said print line and coupled to respective other ends of associated lift levers. The stepping motors operate respective lead screws to increment an associated lead screw nut vertically. A bail extending across said print line is coupled at each end to a respective lead screw nut. The shift shutter is coupled to said bail for movement along the line of print in response to print head movement and in the vertical direction in response to vertical motion of the lead screw nut whereby the desired ribbon bands are indexed vertically to the desired color at the desired column location in front of the print head to effect impact printing by activated print wires of symbols of desired color.

BRIEF DESCRIPTION OF THE DRAWING

These as well as other objects and advantages of this invention will be better appreciated and understood by reference to the following detailed description of the presently preferred exemplary embodiments taken in conjunction with the accompanying drawings of which:

FIGS. 4A, 4B and 4C illustrate schematically various multicolor ribbon details useful in explaining the present invention.

DESCRIPTION OF THE PREFERRED EMBODIMENT

Figure 1:
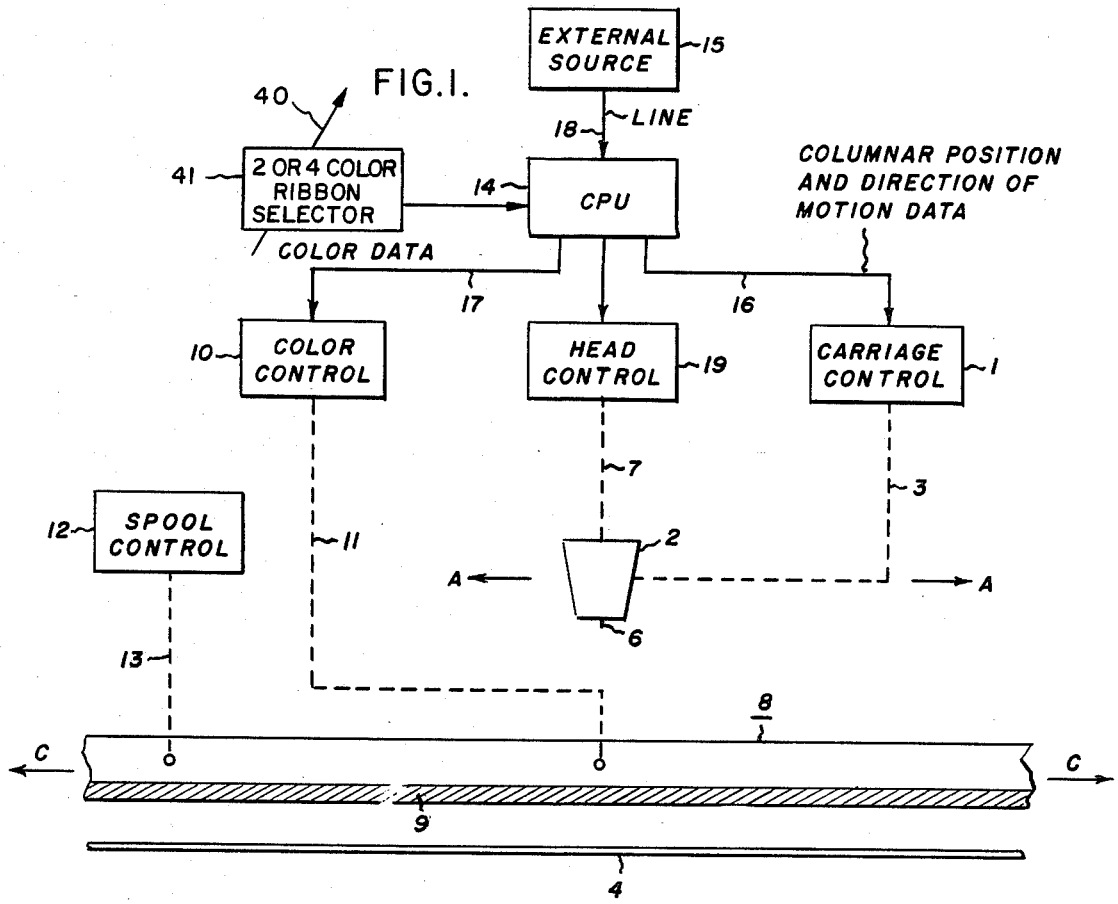
FIG. 1 illustrates schematically and in block diagram form the elements employed in effecting multicolored printing in a matrix printer application.

Referring to FIG. 1 there is shown schematically a multicolor printing arrangement comprising a carriage control 1 for moving print head 2 horizontally by mechanical means 3 such as a carriage 50 (see FIG. 2) shown in dotted line along a line of print in either directions AA in front of a record medium 4 such as paper. A head control 19 moves a plurality of individually controllable print wires carried by head 2 by means 7 shown in dotted line to impact a colored ink print ribbon 8 against the record medium 4 to print a colored symbol. To select a desired band of color 9 on the ribbon 8, a color control 10 moves the ribbon 8 vertically by means of 11 in the direction perpendicular to the drawing to position the selected band 9 opposite the print wires 6. A spool control 12 moves the ribbon 8 by means of 13 in the directions CC to provide a new inked surface of the ribbon 8 to the print wires 6 to insure uniform print quality. The operation of carriage control 1, head control 19 and color control 10 are controlled by data received from a microprocessor 14 over links 16 through 17 which in turn receives symbol printing information from an external source 15 over link 18.

Figure 2:
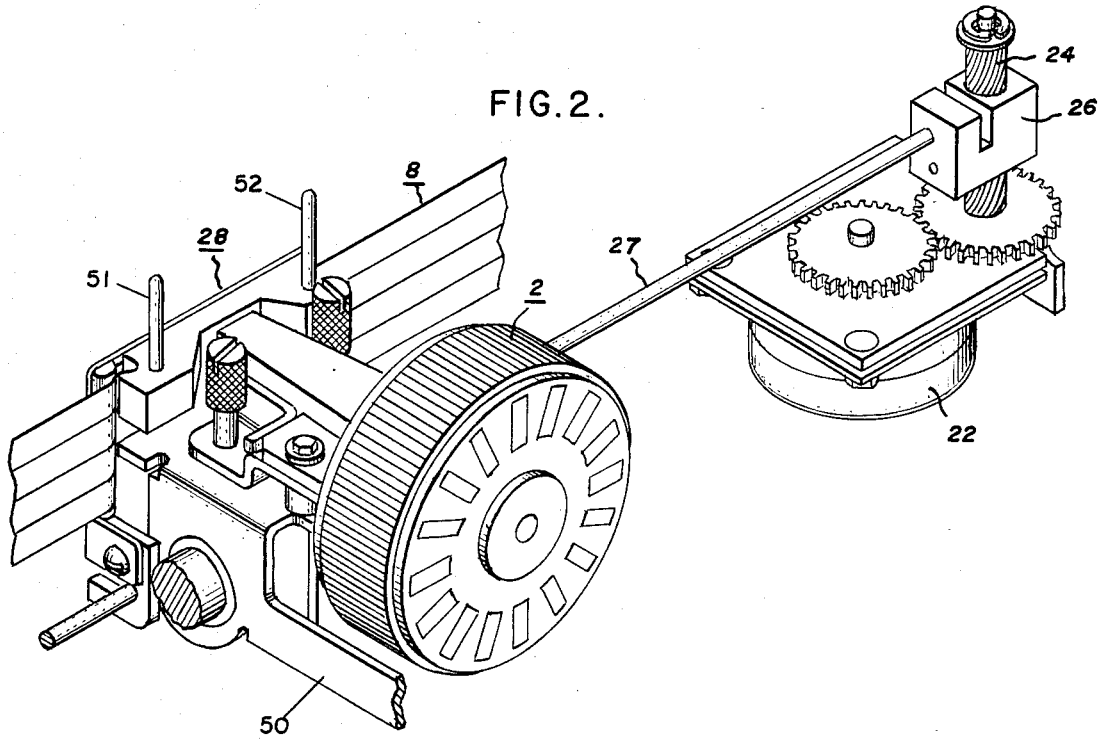
FIG. 2 shows in detail a lead screw and motor assembly for effecting controlled vertical movement of a ribbon.
Figure 3:
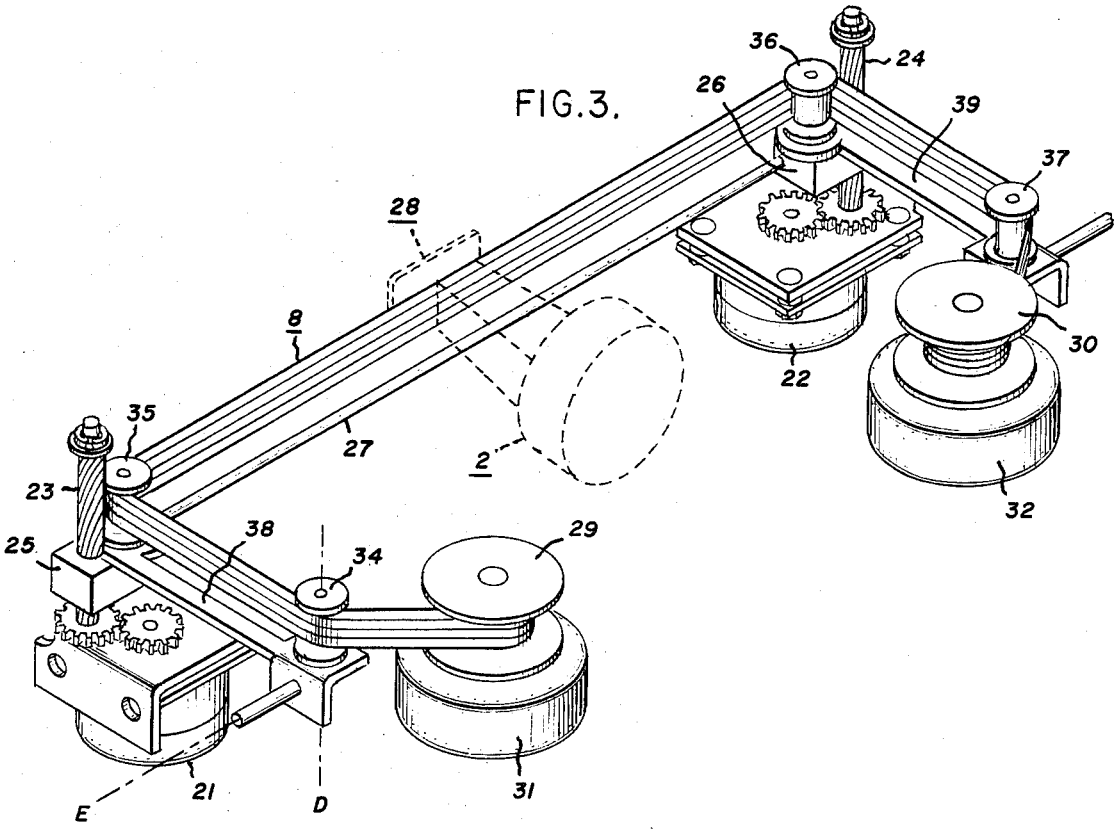
FIG. 3 shows in detail a printer incorporating the elements of FIG. 2 and providing ribbon movement in two directions coordinated with print head movement and print wire actuation.

The manner in which the ribbon 8 is controlled in the vertical directions will now be explained. Referring to FIGS. 2 and 3, the print head 2, as well as the shift shutter 28, is carried by carriage 50 and moved transversely along the print line in response to carriage 50. The ribbon shifting system comprises two step motors 21 and 22, two helical lift screws 23 and 24 with associated nuts 25 and 26, a bail 27 and shift shutter 28 (see FIG. 3). Upon appropriate software commands the two step motors 21 and 22 index (in parallel) a predetermined number of steps, rotating through appropriate gearing the lift screws 23 and 24 thus raising or lowering the nuts 25 and 26 and the bail rod 27 affixed thereto. As the bail raises or lowers vertically, the shift shutter 28 is constrained to move vertically in a plane along posts 51 and 52 which in turn are supported on carriage 50. The ribbon 8 is slidably retained by the shift shutter 28 so that as the carrige 50 moves along the print line, the ribbon 8 slides through the shift shutter 28. This vertical movement by the bail raises or lowers the ribbon 8 supported by the shutter and confined to a predetermined vertical plane by posts 51 and 52 to predetermined channel positions. The ribbon 8 wound on spools 29 and 30 is driven in one direction across a print line or the opposite direction by respective step motors 31 and 32 under the control of stepping pulses provided from a microprocessor.

The advantages of the present shift shutter arrangements are several. Where ribbon indexing to different color channels must occur frequently and at high speeds, ribbon vibration and flutter in front of the print head must be damped. Where the ribbon contains many narrow band channels, the problem of precisely indexing the desired channel in front of the print wires becomes acute, particularly at high operating speeds. The mechanism for presenting changing, desired portions of the ribbon to the print wires should desirably be simple, compact, inobtrusive, inexpensive and reliable. These desirable qualities are substantially achieved by the present invention.

Referring to FIG. 3, the ribbon 8 for example leaving spool 29 acting as a takeoff reel, passes around guide rollers 34, 35, 36 and 37 to the takeup spool 30. Guide rollers 34 through 37 rotate around respective vertical axes such as D shown for roller 34 to facilitate the movement of ribbon around the rollers. In addition, rollers 34 and 35 are coupled together by lift lever 38 and rollers 36 and 37 by lift lever 39 respectively. Each of guide rollers 34 and 37 also rotate about a respective horizontal axis such as E shown for roller 34. Thus guide rollers 34 and 37 rotate about both horizontal and vertical axes. The purpose of having guide rollers 34 and 37 also rotate about respective horizontal axes is to insure good ribbon tracking as the ribbon moves from one spool, say 29, to the other ribbon spool 30 and vice versa. The mechanism for causing guide rollers 35 and 36 to move vertically up and down about respective horizontal axes such as D is that the levers 38 and 39 are attached to respective nuts 25 and 26 which carry the respective rollers 35 and 36. The nuts in turn are driven vertically up and down in response to rotation of the lead screws 23 and 24 which are coupled to respective nuts 25 and 26. Thus by appropriate commands received over line 19, the microprocessor 14 directs the color control 10 to move the ribbon 8 vertically such that a desired color band of the ribbon is presented to the print wires 6 at a desired column location. The column location is established by signals applied by 14 to the carriage control 1 which positions the print head 2 at such desired column location.

Figure 4A:
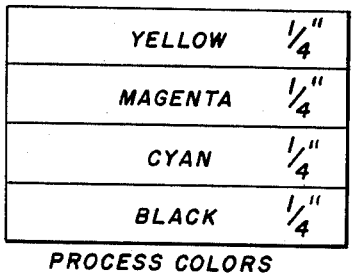
Figure 4A:
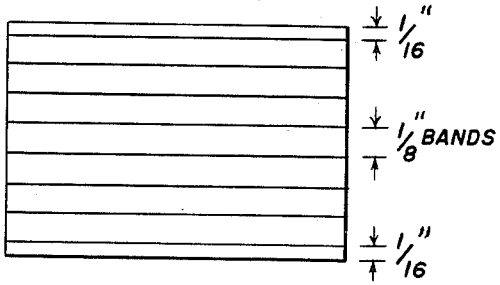

In one embodiment the ribbon was formed of multiparallel bands of colored ribbon as for example comprising the process colors yellow, magenta, cyan and black as shown in FIG. 4A. The ribbon was an inch wide with each band a quarter inch wide. If, for example, the printer were instructed to print the color magenta, the stepping motors 21 and 22 would receive stepping pulses from the microprocessor directing the lead screws 23 and 24 to rotate a sufficient distance to move their associated nuts 25 and 26 vertically so as to position the magenta band of colored ribbon to the desired print line. Signals given to the print head 2 by head control 4 would result in printing the desired characters in the selected color at the print head column locations established by carriage control 1. The print head is designed to move for printing purposes in either direction AA. This is commonly referred to as bidirectional printing. By instructing the stepping motors 21 and 22 to advance the ribbon vertically in response to commands from the microprocessor 14 various mixing of colors may be achieved. For example, when the stepping motors 21 and 22 receive control stepping pulses to move any of the bands of color in the print ribbon at the appropriate time to the print line various combinations of color printing on the same line, including single color printing, is obtained. This could occur during one sweep of the print head 2 across the line of print without any line feeding of paper. To obtain mixing, the stepping motors 21 and 22 receive different commands from 14 during the forward and return pass of the print head along a given print line to move different desired bands of print ribbon to the print line at an appropriate time to obtain overprinting and hence mixing of the different colors at the same column location on the same print line. Thus for example, in passing from left to right the color yellow might be printed in one location on the line, the color magenta in another portion of the line and the color cyan on a third portion of the line. On the return sweep the ribbon would be moved vertically to obtain overprinting of the cyan band of print color onto the previously printed yellow characters to obtain green. Thus by overprinting in this manner, one can obtain many different possible combinations of colors by combining printing in one of the colors and overprinting in a different color during the forward and return portions of the print head across the print line without any line feeding.

Figure 4C:
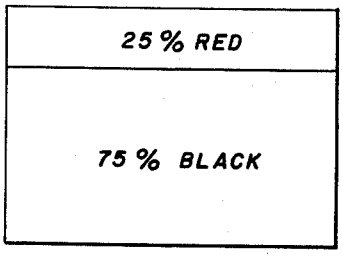

To meet the special needs as for example where there is to be predominant printing of black with an occasional printing of red, a ribbon may be employed involving color bands that are essentially 25% red and for example 75% black as shown in FIG. 4C. In this situation, the stepping motors 21 and 22 would move the ribbon vertically so that the red band is positioned at the print line whenever it is desired to print red characters and the ribbon is positioned to the black band whenever it is desired to print black characters. To make use of the larger band of black, the steppings motors 21 and 22 respond to commands from the microprocessor 14 to print, for example, in one direction over a desired length of the top portion of the black band of ribbon. When the ribbon reaches its end of travel and is caused to reverse its direction and move in the other direction, the microprocessor 14 is programmed to instruct the stepping motors 21 and 22 to move the ribbon 8 vertically so that printing occurs along the middle band of the black portion of the ribbon. When again the end of the ribbon is reached and the stepping motors 21 and 22 are commanded by spool control 12 to move the ribbon in the opposite direction, the stepping motors 21 and 22 are instructed to increment the ribbon vertically after each reversal so that printing takes place along the entire portion of the black ribbon. In this way the entire 75% of the black portion of the ribbon is utilized. Obviously, various combinations of colors and portions of the total ribbon may be employed to suit the special needs.

Referring to FIG. 4B there is shown a one inch ribbon, for example, which has essentially seven eighth inch band portions for printing. The top and bottom 1/16 inch of the ribbon is provided for spacing. In this instance, the microprocessor directs the stepping motors 21 and 22 to move the ribbon from, for example, the first band to the second band at the end of the ribbon travel in the one direction and then from the second to third band during the opposite end of travel of the ribbon alternating this way until all seven bands have been printed on. This vertical incrementing of the ribbon can be repeated in the reverse direction or one may skip and start from the top of the ribbon proceeding to the bottom or one may use any other combination of eighth inch band of ribbon traversals to most effectively use the ribbon. This process optimizes use of the inked portion of the ribbon as desired while minimizing ribbon wear.

The lift screws 23 and 24 are incrementally rotatable by their associated step motors 21 and 22 and the associated gearing such that a predetermined number of stepping pulses, for example 12, applied to the step motors 21 and 22, causes the incremental rotation of the associated lift screws to move the bail 27 and hence the ribbon 8 a specific vertical distance, as for example a quarter inch, representing the spacing between two adjacent color bands. By operating control 40 of the 2 or 4 color selector 41, the microprocessor 14 is programmed to change the number of stepping pulses required to move the ribbon to a different vertical distance, as for example, 36 step pulses to achieve a half inch displacement and 18 step pulses to achieve a quarter inch displacement.

While the invention has been described with particular reference to the construction shown in the drawings, it is understood that further modification may be made without departing from the true spirit and scope of the invention, which is defined by the claims appended hereto.

What we claim as new and desire to secure by Letters Patent of the United States is:

1. An arrangement for printing symbols on a record medium at selected column locations along a print line in a combination of desired colors corresponding to parallel bands of different colored ribbon movable along the print line comprising a print head, said print head comprising selectively activatable print wires, a ribbon lift mechanism, first means for moving said ribbon in response to a first set of control pulses in either direction along said print line at a desired rate, second means responsive to a second set of control pulses to increment the ribbon vertically in either direction to present desired color bands of said ribbon to said print line at desired column locations along said print line, third means responsive to a third set of control pulses to move said print head along said print line to selected column locations, and fourth means responsive to a fourth set of control pulses to selectively activate said print wires in a direction to impact said desired color band of ribbon against said record medium to effect printing of symbols corresponding to said selectively activated print wires in said desired color on said record medium, said third means comprising a carriage for moving said print head along the print line in either direction, said second means comprising a ribbon shift shutter receiving the ribbon moving across the line of print coupled to said carriage for movement with the print head, a pair of lift levers each carrying a ribbon guide roller at one end adjacent said print line and positioned at opposite ends of said print line, each of said lift levers adapted for vertical rotational motion at the other end remote from said print line about a respective axis, means for moving said shift shutter vertically in response to said second control pulses comprising a step motor and associated helical lift screw and nut arrangement positioned at opposite ends of said print line and coupled to respective said one end of associated ones of said lift levers, said stepping motors operating respective helical lift screws to increment an associated lead screw nut vertically, a bail extending across said print line coupled at each end to a respective lead screw nut, said shift shutter coupled to said bail and carriage for movement along the line of print in response to carriage movement and in the vertical direction in response to vertical movement of the lead screw nut whereby a desired color band of said ribbon is indexed vertically to said print line at a desired column location in front of the print head to effect impact printing by activated print wires of symbols of desired color.

2. An arrangement for printing symbols on a record medium comprising:

a print head mechanism movable along a print line to selected column locations; and means for printing at said selected column locations along said print line in a combination of desired colors corresponding to parallel bands of colored ribbon movable independently of said print head movement along the print line including a ribbon lift mechanism having first and second digital motor means disposed at opposite ends of the print line and rotationally driving respectively associated first and second lift screws to vertically index corresponding first and second threaded nut assemblies which support said ribbon, a source of information, a microprocessor responsive to said information to produce color data signals, a source of first stepping pulses, means for moving said ribbon in response to said first stepping pulses along said print line at a desired rate, means responsive to said color data signals to provide second stepping pulses, and said digital motor means being responsive to said second stepping pulses to incrementally step the ribbon position vertically in either direction to present a desired color band of said ribbon to said print line.

3. An arrangement for printing symbols on a record medium at selected column locations along a print line in a combination of desired colors corresponding to parallel bands of colored ribbon positioned along the print line in front of a print head comprising a ribbon lift mechanism, a source of information, a microprocessor responsive to said information to produce color data signals, means responsive to said color data signals to provide stepping pulses, means for suspending said ribbon from opposite ends of said print line, a bail suspended between opposite ends of said print line, a ribbon shift shutter constrained for movement in a predetermined vertical plane and coupled to said bail, means for moving said suspended ribbon in front of said print head, means to move the ribbon within said plane to present a desired color band of said ribbon to said print line comprising incrementally rotatable means located at opposite ends of said print line for moving said bail to desired elevations in response to a predetermined multiple of said stepping pulses.

4. An arrangement according to claim 3 further comprising means for changing said predetermined multiple of said stepping pulses to change said desired elevations.

5. An arrangement for printing symbols on a record medium by movement of a print head to selected column locations along a print line in a combination of desired colors corresponding to parallel bands of colored ribbon not carried by said print head but movable along the print line, said arrangement comprising:

a ribbon lift mechanism having first and second digital motor means disposed at opposite ends of the print line and rotationally driving respectively associated first and second lift screws to vertically index corresponding first and second threaded nut assemblies which support said ribbon, a source of information, a microprocessor responsive to said information to produce color data signals, a source of first stepping pulses, means for moving said ribbon in response to said first stepping pulses along said print line at a desired rate, means responsive to said color data signals to provide second stepping pulses, and said digital motor means being responsive to said second stepping pulses to incrementally step vertically, in either direction, substantially only the section of ribbon then addressing said print line to present a desired color band of said ribbon to said print line.

* * * * *